US011957161B2

(12) United States Patent
Bode

(10) Patent No.: US 11,957,161 B2
(45) Date of Patent: Apr. 16, 2024

(54) DEVICE AND METHOD FOR FORMING A NATURAL LEAF SMOKABLE PRODUCT

(71) Applicant: Sharon Moore Bode, Coral Gables, FL (US)

(72) Inventor: Sharon Moore Bode, Coral Gables, FL (US)

( * ) Notice: Subject to any disclaimer, the term of this patent is extended or adjusted under 35 U.S.C. 154(b) by 433 days.

(21) Appl. No.: 17/396,580

(22) Filed: Aug. 6, 2021

(65) Prior Publication Data

US 2022/0039457 A1 Feb. 10, 2022

Related U.S. Application Data

(60) Provisional application No. 63/062,220, filed on Aug. 6, 2020.

(51) Int. Cl.

| | |
|---|---|
| ***A24D 1/18*** | (2006.01) |
| ***A24C 5/44*** | (2006.01) |
| ***A24D 1/00*** | (2020.01) |
| ***A24D 1/02*** | (2006.01) |

(52) U.S. Cl.
CPC ..... *A24D 1/18* (2013.01); *A24C 5/44* (2013.01); *A24D 1/002* (2013.01); *A24D 1/02* (2013.01)

(58) Field of Classification Search
None
See application file for complete search history.

*Primary Examiner* — Phu H Nguyen
(74) *Attorney, Agent, or Firm* — Mark C. Johnson; Johnson |Dalal

(57) ABSTRACT

The present invention provides a rolling device and method for forming a natural leaf smoking product comprising the steps of providing a *Diospyros melanoxylon* leaf body, which may be a recycled reconstituted *Diospyros melanoxylon* paper, acting as a binder material, having an inner body surface with pubescent straight trichomes disposed thereon; providing a hemp component acting as a filler material; disposing the *Diospyros melanoxylon* leaf body in an operative configuration with the outer body surface on a support surface and the inner body surface facing upwardly for receiving the hemp component; applying the hemp component over the pubescent straight trichomes; and wrapping the *Diospyros melanoxylon* leaf body, which may be a recycled reconstituted *Diospyros melanoxylon* paper, around the hemp component to form an encased smoking product.

20 Claims, 11 Drawing Sheets

DEVICE AND METHOD FOR FORMING A NATURAL LEAF SMOKABLE PRODUCT

FIELD OF THE INVENTION

The present invention relates primarily to a device used to form a natural leaf smokable product such as, but not limited to, a smaller version of a cigar. The present invention also relates to an improved method of forming a tobacco product, and most preferably, a method of forming a smaller version of a cigar in a quick and efficient manner but with reliably consistent quality. Importantly, the present invention is also directed to a method for developing the hemp industry by producing a smokable hemp product capable of directly competing with traditional cigarettes and of being marketed to cigarette consumers.

BACKGROUND OF THE INVENTION

It is said that for those who smoke cigars, the level of pleasure offered in smoking a good cigar rivals few other genuine pleasures in life. This is no doubt attributed to the quality and blend of tobacco leaves chosen for making the cigar, as well as to what is often a pre-selected time and place with ambience to enjoy smoking it. There is, however, another highly important aspect which contributes to the pleasure of smoking a cigar, which includes the selection of fine tobacco or specially chosen blends of fine tobacco to create the cigar. Another important aspect relates to the care and attention to detail given in forming the cigars, which for maximum pleasure are hand formed, or in some cases, assisted with mechanical tools while being hand produced, and allowed time to form, or dry. In fact, most cigar connoisseurs usually prefer hand-rolled cigars to fully machine-made cigars. The hand forming of many great cigars, and not just famous brand-name cigars is often considered key, and the degree of care and attention given to hand rolling a cigar can even be said to rise to a level of being viewed as a form of art. It is generally, however, a labor intensive and time-consuming process.

As briefly noted above, a critical first step is the selection of the tobacco leaves that will be used to make up what is known as the "filler" as this directly affects the taste, aroma and draw of the cigar. While many believe the best tobacco leaves for making cigars come from Cuba, or particular regions of Cuba, many others also believe that other countries' tobacco and smokable wrapper leaf including the Dominican Republic, India and Sri Lanka, to name a few, have the best wrapper and filler leaves. Still others believe in blending tobacco leaves from some of these countries in order to form a perfect smokable product. In fact, many of the best cigar labels blend several types of tobacco, with the precise formulations being closely guarded as treasured and valuable trade secrets. Regardless of the blend of leaves selected, an important goal is to create a "filler" and to form it into a smokable product that will burn relatively evenly and satisfactorily. As such, preparation of the selected leaves is usually the next step. Some smokable products are formed using cut-up pieces of tobacco or milled hemp leaves, which can be quite small and somewhat uniform in size. It will be appreciated, however, that some others prefer to use whole leaves to form the smokable product, rather than cut or milled leaves. Moreover, it should be appreciated that somewhat different steps can be followed in making a smokable product beyond those discussed herein.

In nearly all cases though, a suitable "binder leaf" will be selected for use in containing the cut or whole leaf material, essentially to hold the filler in. The "binder leaf" or "binder" is usually a tobacco leaf or other smokable leaf that will have sufficient elasticity and strength to keep the filler together. It will typically be laid on a clean flat surface with the cut or milled pieces then sprinkled onto it in an appropriate amount to avoid both overstuffing and under stuffing. Using the correct amount of filler is considered critical to the construction of a good smokable product, as an over filled cigar or hemp stick will be hard to draw on, and an under-filled one will burn too quickly, but a properly filled and lit smokable product will burn evenly. In some instances, the binder leaf is filled with either cut or whole leaf while using a "lana" as well, which is a piece of leather-like material used by some in initially forming or rolling the product. Again, other methods may be selected or steps followed. For example, some but not all will apply a light misting of clean water to the binder leaf as a next step in order to moisten it and the filler and help with the actual forming of the product. Whether that step is followed or not, the binder leaf will typically be wrapped or rolled around the cut or whole leaves which serve as the filler, while consistency is looked for in terms of whether more filler or less filler is needed. This wrapping of the filler is thought to influence the taste, burn and aroma of the smokable product. Also, the resulting "ring gauge" or diameter of the product will often be used by consumers to arrive at an idea of how full bodied the smoke of the cigar or hemp stick will be. For instance, some believe that cigars with a large ring size will yield a smoother, slower and cool smoke. The ring gauge is the standard for measuring the diameter of a cigar, with 0.64 ring being equal to one-inch diameter.

At this point, the rolled filler in a binder leaf is typically put in a "former" or wooden block, an example of which is shown in FIG. 1 and labeled as "Prior Art," to create the cigar's shape. A "former" is used to give the cigar a smooth shape and appearance, and to provide an interval of time in which the natural process of shaping the cigar will occur. Formers are basically two relatively large pieces having gaps or channels within them, that when fitted together, with a rolled filler and binder leaf held inside, and with a sufficient lapse of time, will result in the forming of a plurality of cigars, with each having in general the same length and width. Gaps of around 15 mm are common for an average cigar. After a period of time has passed, the rolled filler and binder leaf will be removed from the wood former, and typically, an additional tobacco leaf called a "wrapper" will be applied to the now "molded" binder leaf and filler, which effectively completes the manufacturing process for a cigar. Also, in some cases and while not necessary, the wood former holding the rolled filler and binder leaf can be put in a press in order to hasten the drying and forming process.

As can be appreciated from FIG. 1, while these known cigar formers in the prior art may function perfectly for the intended purpose, they are typically quite cumbersome and difficult to maneuver, move around and lift. In fact, it is believed that all cigar formers known to date are either made of wood or a similar solid and heavy, material. In addition, known formers are typically quite large and bulky, and as a result, take up a lot of work space whether on a table, desk or other work surface.

There is, therefore, a need in the field of art relating to cigar making for a new and improved cigar forming device.

In addition to the foregoing, it should be appreciated that in times of economic turbulence, such as during a recession, the purchase and consumption of full-size cigars may be viewed as somewhat of a luxury. Moreover, there is often pressure to increase prices for high quality tobacco leaves, the availability of which can be affected by drought, storms or extreme weather. Another factor contributing to price increases is the cost of labor, which tends to rise over time, and the cost of transporting the tobacco to various places for use in creating a tobacco product, which once created, must also be transported to consumers. Further, it should be pointed out that consumers' preferences and tastes for tobacco products can change over time, and that as of this writing, there is a noticeable trend in the US market away from traditional cigarettes and the inclusion of a Federally legal smokable hemp product.

Consequently, and due to both economic and other generally uncontrollable factors, it would be ideal if an improved smokable product forming device were developed which could reliably be used to form smaller versions of cigars and smokable hemp products, whether a "mini-cigar," "little" cigar, "hemp stick" or some other, similar type of smokable product. If any such improved device were developed, it would ideally offer the ability to roll or form the product primarily by hand, so as to preserve the high quality levels associated with hand rolled cigars and smokable hemp products, while at the same time, allowing several such products to be made quickly. Any such improved device would preferably also be capable of being assisted by machine, whether partially or fully, during the manufacturing process. Any such improved device, if developed, would also ideally offer a resulting product that has a visibly noticeable smooth and nearly perfect exterior finish, which further, would be capable of competing directly with traditional cigarettes and of being marketed to consumers of traditional cigarettes, and which therefore, could readily be utilized as part of a business method to develop and grow the cigar and hemp industries.

SUMMARY OF THE INVENTION

The present invention is designed to address these and other needs in the field of art relating to the forming of the afore mentioned products. As such, the present invention is directed in one primary embodiment to a device that is structured to facilitate the forming of a smokable product, and ideally, a smaller sized product. As will become clear from the detailed description of the invention which follows, as well as the attached drawings, the device of the present invention comprises a body having an elongated configuration and an outer wall. Additionally, the body of the device includes a hollow interior, in which leaf components making up the resulting smokable product will be received for forming, with the outer wall of the body disposed in surrounding relation thereto. In the preferred embodiments, the hollow interior will terminate at opposite ends of the body, and the body will have a cylindrical shape, as defined by a circumferential boundary of the outer wall. Also, the outer wall of the device's body is, in the most preferred embodiments, continuous, with the body made from a single piece of material that is flexible, such as but not limited to a plastic material, plastic blended material or another material currently known or yet discovered which offers similar characteristics. However, in other embodiments, the device can be made of a solid material such as, but not limited to metal, a metallic material, aluminum, etc.

In some embodiments, such as the illustrated embodiment, in the body includes an access opening formed in the outer wall which extends along the length thereof and which is in communicating relation with the hollow interior. Further, the construction of the outer wall in this embodiment will not only be of a flexible material, but one that also includes an at least minimal inherent bias, so as to allow the body to be disposable in and between a first, normally contracted orientation and a second, expanded orientation. The construction of the outer wall will also permit opening and at least partial closing of the access opening, with the inherent bias being sufficient to normally dispose the outer wall into the contracted orientation and in confronting, forming relation to a leaf product disposed within the hollow interior of the body.

The present invention is also directed to a method of forming a natural leaf product, such as a cigar or ideally, a smaller version of a cigar, using the inventive device. In the preferred embodiments, the method comprises the steps of collecting leaf components which will be used to form the cigar or hemp stick, disposing the leaf components within the hollow interior of the inventive body, followed by allowing the leaf components to remain within the hollow interior for a period of time in order to form the product into an intended configuration. This method may alternatively include one or more additional steps if the inventive device having an access opening is used. For example, the method can comprise in addition to the step of collecting leaf components which will be used to form the cigar or hemp stick, the steps of disposing the inventive device's outer body wall in the expanded orientation for receiving the leaf components within the hollow interior of the body, and sufficiently opening the access opening to facilitate passage of the leaf components there-through into the hollow interior, followed by positioning the outer wall into the contracted orientation and in enclosing relation to the hemp components within the hollow interior, and then exerting sufficient biasing force, via the inherent bias of the outer wall, on the enclosed hemp components for a period of time to form the smokable product into an intended configuration.

Additionally, the present invention is directed to a business method for developing and growing either or both the cigar and hemp industries. This method involves utilizing the inventive device(s) described herein to create a smaller version of a smokable product, and ideally, one that is sized to be packaged like and to directly compete with traditional cigarettes, and to be marketed to consumers of traditional cigarettes. Because the inventive device can be utilized to hand roll and form a leaf product more quickly than is currently possible with other formers, this inventive business method allows for cigars, hemp sticks, and smaller sized smokable products in particular, to be more efficiently made by hand, while still allowing a suitable amount of time to pass or a smaller amount of time to pass, for forming the resulting smokable product. Alternatively, the inventive device can be employed within or readily utilized as part of a machine-made process for forming a tobacco or hemp product or more preferably, a smaller version of a cigar to directly compete with the cigarette industry.

In accordance with another feature, the method includes a further step of providing a recycled reconstituted *Diospyros melanoxylon* paper from pieces of *Diospyros melanoxylon* leaf.

In accordance with a further step of the present invention, the method also includes the step of applying the hemp component exclusively over a length and density of the pubescent straight trichomes.

In accordance with one embodiment of the present invention, the method further includes the steps of providing a rolling device with a body of an elongated configuration and having two opposing free ends separated by a length and an outer wall extending the length of the body and surrounding and defining a hollow interior spanning the length of the body and defining a boundary thereof; and disposing the *Diospyros melanoxylon* leaf body in the operative configuration with the outer body surface confronting an inner surface of the outer wall of the body, forming the support surface.

In accordance with another embodiment, the method includes the additional steps of disposing the body in an operative relation for receiving the hemp component within the hollow interior; disposing the outer wall in the expanded orientation and sufficiently opening the access opening to facilitate passage of the hemp component therethrough into the hollow interior; positioning the outer wall into the contracted orientation and in enclosing relation to the hemp component within the hollow interior; and exerting sufficient biasing force, via the inherent bias of the outer wall, on the enclosed hemp component to form the encased smoking product and an intended configuration.

In accordance with a further feature of an exemplary embodiment of the present invention, the method may also comprise the step of assembling the hemp component into a preformed *Diospyros melanoxylon* leaf body and disposing the preformed *Diospyros melanoxylon* leaf body into the hollow interior.

In accordance with another step, the method includes further comprising a structuring the outer wall and the inherent bias to exert a sufficient biasing force on the outer wall of the preformed *Diospyros melanoxylon* leaf body to shape the *Diospyros melanoxylon* leaf body into the intended configuration.

In accordance with a further step, the method also comprises placing the preformed *Diospyros melanoxylon* leaf body within the hollow interior of the body by hand.

In accordance with a preferred embodiment, the method includes the step of placing the preformed *Diospyros melanoxylon* leaf body within the hollow interior of the body by machine.

In accordance with another preferred embodiment, the body is formed of a rigid and flexible material.

In accordance with another feature of the present invention, the method includes the additional steps of providing a rolling device with a body with an elongated configuration and an outer wall extending along the length of said body, the body including a hollow interior terminating at opposite ends of said body, the outer wall disposed in an at least partially surrounding relation to said hollow interior and structured to define a circumferential boundary thereof, and the outer wall comprising a continuous, one piece, flexible material construction including an at least minimal inherent bias; and forming an access opening formed in said outer wall and extending along a length thereof in communicating relation to said hollow interior, the outer wall disposable in and between expanded and contracted orientations upon an opening and at least partial closing of said access opening and the inherent bias being sufficient to normally dispose said outer wall into said contracted orientation and in confronting, forming relation to the *Diospyros melanoxylon* leaf body disposed within the hollow interior.

In accordance with a further feature, the inherent bias is at least sufficient to exert a compressive biasing force on the *Diospyros melanoxylon* leaf body within said hollow interior when said outer wall is in said contracted orientation.

In accordance with yet another feature, said expanded orientation comprises a sufficient opening of said access opening to dispose the *Diospyros melanoxylon* leaf body within said hollow interior.

In accordance with the present invention, each of said opposite ends of said body are open and disposed in communicating relation with said hollow interior.

In accordance with a further feature, said access opening extends along the length of said outer wall between and in communication with both said open opposite ends.

In accordance with an additional feature of the present invention, said access opening comprises a substantially linear configuration disposed in aligned relation to a longitudinal access of said hollow interior, at least when said outer wall is in said contracted orientation.

In accordance with yet another feature of the method, said outer wall and said inherent bias are cooperatively structured to define said circumferential dimension of said hollow interior to be in substantial conformance to an outer surface of the *Diospyros melanoxylon* leaf body disposed therein, when said outer wall is in said contracted orientation.

In accordance with a further feature of the method, said substantial conformance of said circumferential dimension of said hollow interior with the *Diospyros melanoxylon* leaf body extends along substantially an entire length of the natural leaf product.

In accordance with another feature of one embodiment of the method, the length of said outer wall is equal to or greater than the length of the *Diospyros melanoxylon* leaf body being formed within said hollow interior.

In accordance with yet another feature of the present invention, the length of said outer wall is equal to or greater than a length of the *Diospyros melanoxylon* leaf body being formed within said hollow interior.

Although the invention is illustrated and described herein as embodied in a method of forming a natural leaf smoking product, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

These and other objects, features and advantages of the present invention will become clearer when the drawings as well as the detailed description are taken into consideration.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION OF THE INVENTION

Before any of the embodiments of the present invention are described, it is to be understood that the invention is not limited in its application to the details of construction and/or the components set forth in the following description or to the illustrations shown in the accompanying drawings. The invention is capable of other embodiments and of being practiced and or of being carried out in various ways. Also, it is to be understood that the phraseology and terminology used herein is for the purpose of description and should not be regarding as limiting. The use of the words "including," "comprising" or "having" and variations thereof is meant to encompass the items listed thereafter and equivalents thereto as well as additional items.

As will be described below with reference to FIGS. 2-4, the present invention is primarily directed to a device that is structured to facilitate the forming of a natural leaf product, such as but not limited to a cigar or hemp stick. Most preferably, the inventive device is structured to form a smaller version of a smokable product that ideally, is sized similarly to a traditional cigarette and which can be packaged like traditional cigarettes and marketed to consumers of them. Additionally, the present invention is directed to a method of forming a natural leaf product, such as a cigar, hemp stick or smaller version of a cigar, using the inventive device. Also important, the present invention is further directed to a business method of developing the cigar and hemp industry with a natural leaf product capable of directly competing with traditional cigarettes.

Figure 1:
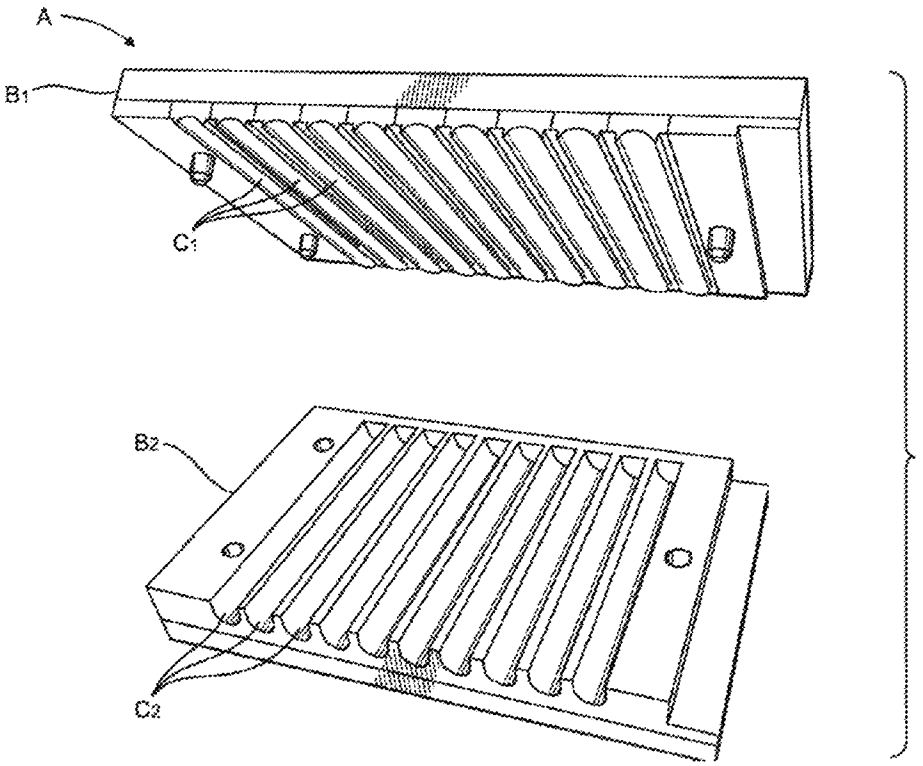
FIG. 1 PRIOR ART
FIG. 1 is a perspective view of a well-known type of wooden block commonly used to form the shape of a plurality of cigars, which is clearly labeled as "Prior Art"

By way of background, however, initial reference will be made to FIG. 1, wherein there is shown a "Prior Art" device, clearly labeled as such, in the nature of a wooden block type of device A, used to form or create a cigar's shape. This type of known device is considered standard in the field of art relating to cigar making, as a "former" for creating or forming the cigar's shape. As shown, this type of former includes two halves, B1 and B2, which are structured to be removably fitted together by way of pegs and holes. Each half includes a plurality of gaps or channels, as at C1 and C2, with each having the same length and width as is desired to form the cigars' shape, when the gaps or channels are filled with a filler and binder leaf, and once the two halves B1 and B2 are fitted together. As described previously, gaps of around 15 millimeters (mm) are relatively common for an average sized cigar. Also, and while the particular dimensions of a wooden "former" can vary somewhat, they are usually about eight (8") inches to ten (10") wide and about twelve (12") inches long. They are also typically about three (3") inches thick, making them somewhat bulky, and since they also weigh a few pounds, they are often somewhat heavy to lift, pick up and move. Not only are such known "formers" somewhat cumbersome to maneuver, they also take up a fairly significant amount of work space, whether on a table, desk or other surface. Consequently, such known formers have a number of drawbacks, especially when the labor intensive process of forming cigars by hand is considered.

Figures 2, 2A:
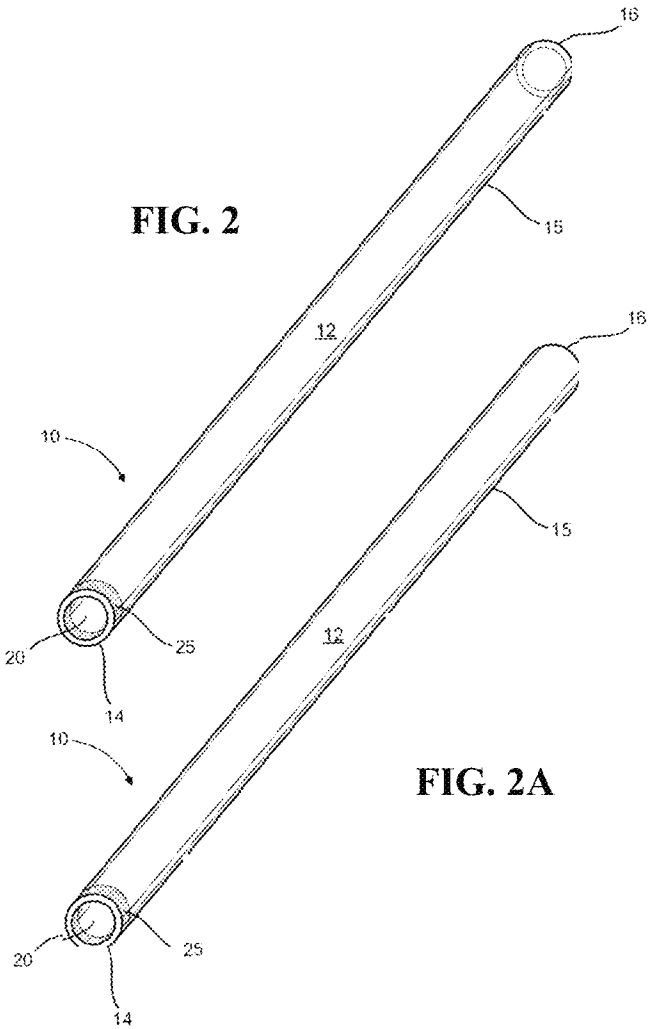
FIG. 2 is a perspective view of a new forming natural leaf smoking product according to one embodiment of the present invention in a first possible embodiment, intended to illustrate a clear plastic material.
FIG. 2A is also a perspective view of a new forming natural leaf smoking product according to the present invention in another embodiment, intended to illustrate an opaque material.

Referring now, however, to FIG. 2, the present invention is primarily directed to a device 10 for forming a natural leaf product, whether of a standard "ring" size of cigars or ideally, a smaller sized smokable product, which may be roughly analogous to that of a cigarette. The device 10 includes a body 12 having an elongated configuration and orientation and an outer wall 15 extending along the entire length of said body 12. Additionally, the body of the device includes a hollow interior 20 defined by an inner surface of the body 12, and that is structured and configured to receive the leaf components that will be formed to create the smokable product with the body 12, with the outer wall 15 of the body 12 disposed in surrounding relation thereto. As illustrated, the hollow interior 20 will preferably, but not necessarily in all embodiments, terminate at opposite free ends 14, 16 of the body 12.

In one embodiment, as illustrated in FIG. 2, the body 12 will have a cylindrical shape, as defined by a circumferential boundary of an outer surface of the outer wall 15. Also, the outer wall 15 of the device's body 12 is continuous and preferably be made from a single piece of material, and may have the inner surface that is substantially smooth (i.e., without any visually perceivable raised surfaces) for forming the smokable product. In some embodiments, the device body can be made from a solid and/or relatively inflexible material, such as but not limited to, metal, a metallic material or aluminum, etc. whether in full or in part, or to glass, clay and clay-like materials. However, an ideally suitable material for forming the inventive device 10 is a plastic material that has both a sufficient degree of flexibility but also, rigidity and durability. FIGS. 2-2A and FIGS. 3-3A are intended to illustrate how the selected material for the body can also be either clear or opaque.

Figures 3, 3A:
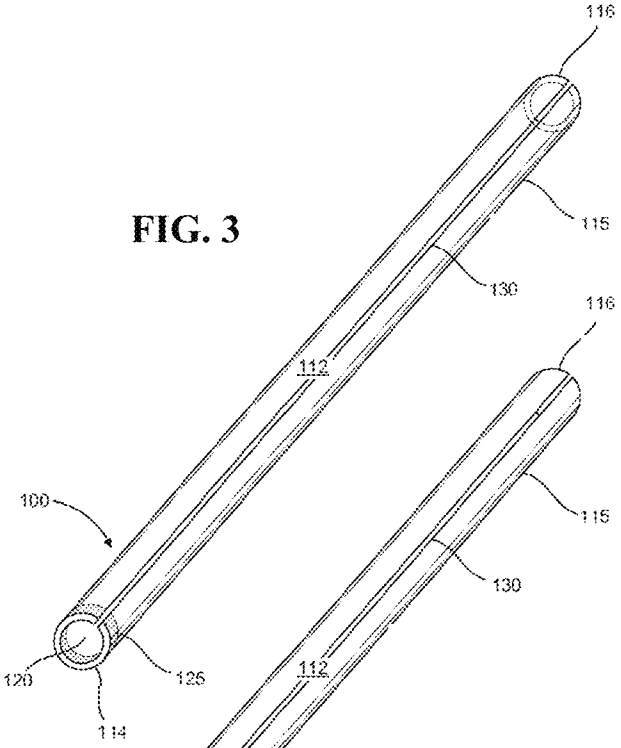
FIG. 3 is a perspective view of a new forming natural leaf smoking product shown in another, preferred embodiment of the present invention, also intended to illustrate a clear material, but having an access opening, and illustrating the body and outer wall of the device in a normally contracted orientation.
FIG. 3A is a perspective view of a device similar to that shown in FIG. 3, but intended to illustrate use of an opaque material to form the body and outer wall of the device.
Figure 4:
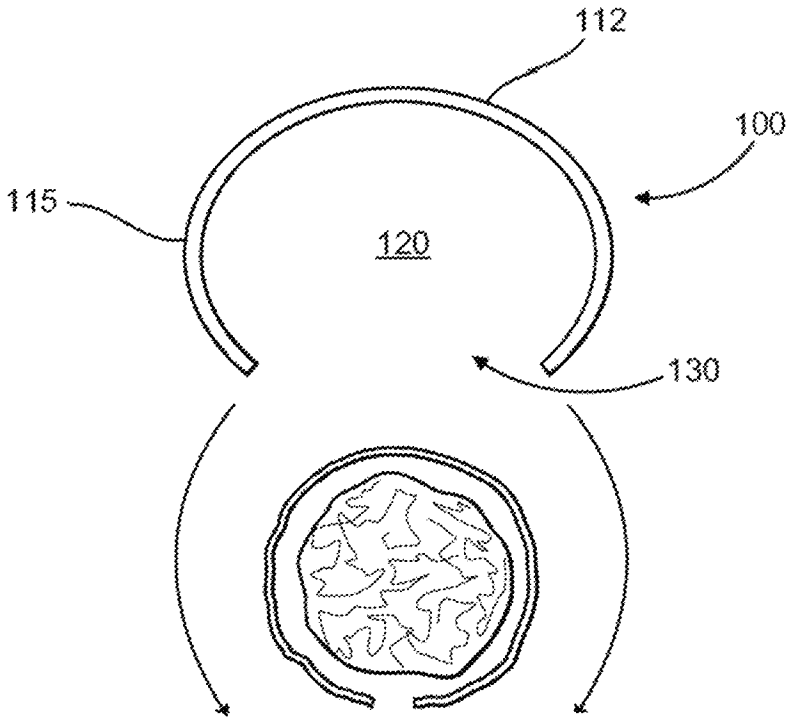
FIG. 4 is a front cross-sectional view of the inventive forming device shown in FIG. 3, but illustrating the body and outer wall in an expanded configuration, with the access opening sufficiently expanded, to permit passage of leaf components into the hollow interior of the body from a preferred orientation.
Figure 5:
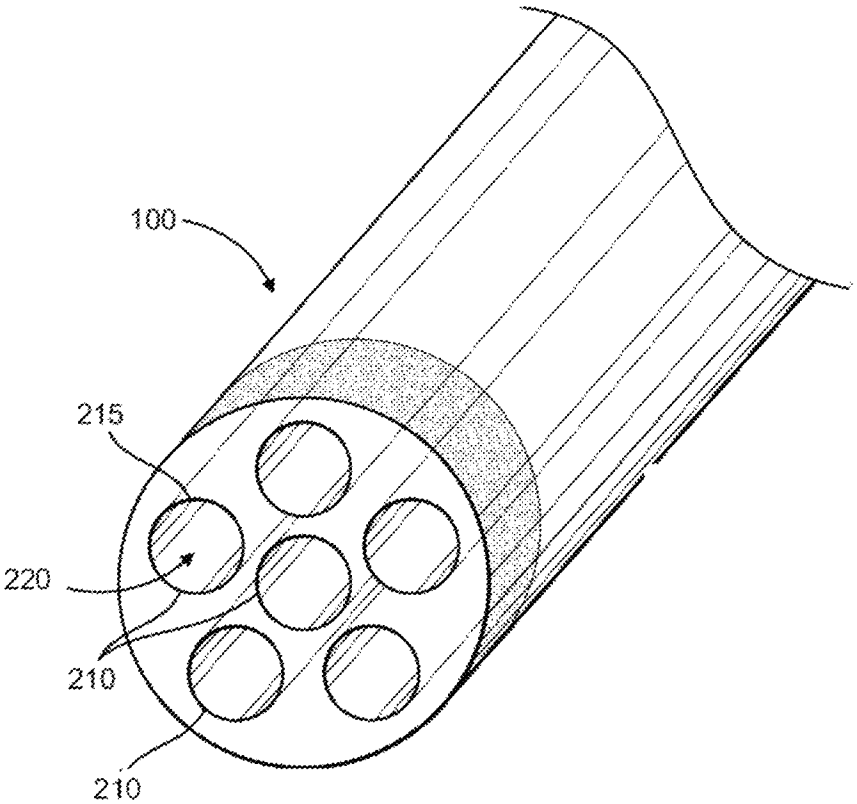
FIG. 5 is a perspective view of an alternative new forming natural leaf smoking product in accordance with another embodiment of the present invention, wherein one or more of smaller-sized smokable products can be formed simultaneously.

Referring now to FIGS. 3-4, the inventive device 100 is shown in an alternative embodiment. This embodiment includes most, if not all, of the above described features associated with FIG. 2. However, in this embodiment, the body 112 of the inventive device 100 also includes an access opening 130. In the illustrated embodiment, the access opening 130 is preferably formed longitudinally in the outer wall 115 of the device 100, and extends substantially along, and preferably, entirely along the length thereof, and is in spatial communication with the hollow interior 120. The access opening 130 is structured to allow a "binder" or "binder leaf" and also, "filler" for the leaf product to be inserted into the hollow interior 120 of the device 100 for purposes of shaping the cigar or hemp stick product. Here as well, the device's body 112 is preferably formed of a suitable material, such as plastic(s) that has both a sufficient degree of flexibility but also, rigidity and durability, to allow the body 112 to be disposable in and between a first, normally contracted orientation shown in FIG. 3, and an expanded configuration, such as is shown in FIG. 4, for purposes that are described subsequently herein. Further, the aforementioned construction of the device 100, and material forming the body 112 will include an at least minimal inherent bias toward the contracted configuration. This at least minimal inherent bias or "memory" of the flexible material used to form the device 100 should be sufficient to cause the outer wall 115 of body 112 to be biased towards the first, normally contracted configuration shown in FIG. 3, even when the filler and binder of the product to be formed are located within the hollow interior 120. In addition to materials noted previously above, the inventor herein contemplates the use of plastic(s) and like flexible materials for the devices 10, 100, such as are known generally for forming a drinking straw, which have never before been considered for the purpose of forming a tobacco or hemp leaf product, let alone a smaller version of a cigar. As such, the outer wall 115 of the device 100 is structured to assume an at least partially contracted configuration while also in confronting, forming relation to a natural leaf product disposed within the hollow interior 120 of the body 112. The smooth inner surface of the body 112 and the outer wall 115 at least relative to the hollow interior 120 will cause the natural leaf product being formed within the device 100 to similarly have a finished and smooth appearance. Additionally, the body 112 may be naturally formed into a C-shape. Moreover, and once a natural leaf product has been formed and removed from the inventive device 100, the aforementioned material and construction of the device's body 112 should be sufficiently durable to allow for repeated use in forming additional smokable products, rather than a single use.

As shown in FIGS. 2-3A, the inventive device 10, 100 can include marking indicia. For instance, the device can include tip marking indicia for indicating, as at 25, 125, to a person utilizing the invention to create a smokable product, to form the filler and binder leaf and to roll it in a particular way, as some prefer, so that the product inside and corresponding to this end 14, 114, will be the end to be lit, as versus the other end corresponding to 16, 116 where the smoker will draw from. It will be appreciated that marking indicia could instead be utilized at the opposite ends 16, 116, but serves as a functional indicia for guiding the user in forming the smokable product. In one embodiment, the marking indicia 25, 125 may be disposed at the terminal end and span discontinuously as shown in the figures. The marking indicia 25, 125 may be of a different color and/or may include one or more raised or depressed surface(s).

Also in one embodiment, as illustrated in FIGS. 2-3A and 5, the inventive forming devices 10, 100 will be structured to have an overall dimension suitable for forming a cigar, but ideally, a smaller version of a cigar of approximately three to four inches long and a width or inner and/or outer diameter of approximately one-half (½) inch or less. It will be appreciated that the devices 10, 100 having such dimensions, and made from the preferred plastic material(s) described previously herein, offers a new type of former that is very light in weight, and further, the possibility that several of these inventive devices 10, 100 can be stored together, whether in an upright orientation, possibly even in a container such as a pencil cup, or in a horizontal orientation, again most likely in another suitable type of container. As a result, the present invention offers significant improvements in the process of hand-rolling cigars, and smaller versions of cigars in particular, due to the fact that only a small amount of work space is taken up by and needed to form the tobacco product.

In addition, it is believed that use of the inventive devices 10, 100 will offer enormous savings in time from what has historically been a labor intensive, hand rolling process, because its use should allow a single laborer to make at least three or four tobacco products per minute. Further, the inventive devices 10, 100 will be re-usable in the preferred embodiments, and when the plastic material forming the device begins to lose the memory characteristics sufficient to assume the desired contracted orientation in confronting, forming relation to a natural leaf product, it can simply be discarded and replaced with a new, relatively inexpensive devices 10, 100. Consequently, the present invention is likely, therefore, to have a profound effect on both the cigar and hemp industry, because the devices, such as 10, 100, is capable of being used to quickly make smaller smokable products, which are essentially custom rolled and formed by hand, and which will still have a smooth and nearly perfect finish, while simultaneously keeping quality very high, thereby yielding a product that can directly compete with traditional cigarettes, as well as traditional cigars, and marketed to the consumers of same.

Accordingly, the present invention is also directed to a method of forming a smokable product, such as but not limited to a cigar or hemp stick, but ideally, and as has been noted above, a smaller version of a cigar, using the inventive devices 10, 100. As has been described, if the goal is to offer a premium quality smokable product or smaller sized version of a cigar, the selection of high-quality leaves or blends of them will be viewed as a critical first step. This step, especially with regard to the wrapper/binder leaf can be viewed as being more proprietary and selective in nature.

Figure 6:
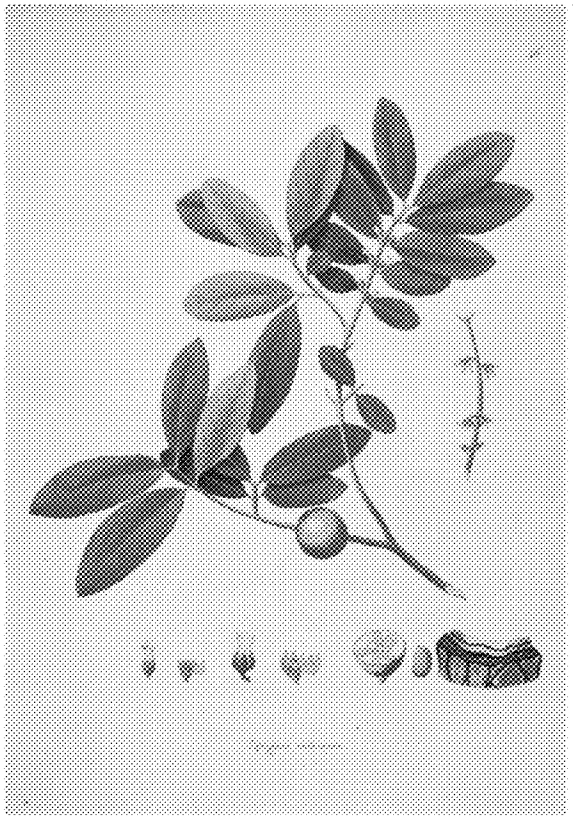
FIG. 6 is a botanical drawing by Botanist of record (1795), Dr. William Roxburgh, providing identification of a known plant leaf species *Diospyros melanoxylon* specifically used by the devices depicted in FIGS. 2-2A and 3-3A when forming hemp sticks.
Figure 7:
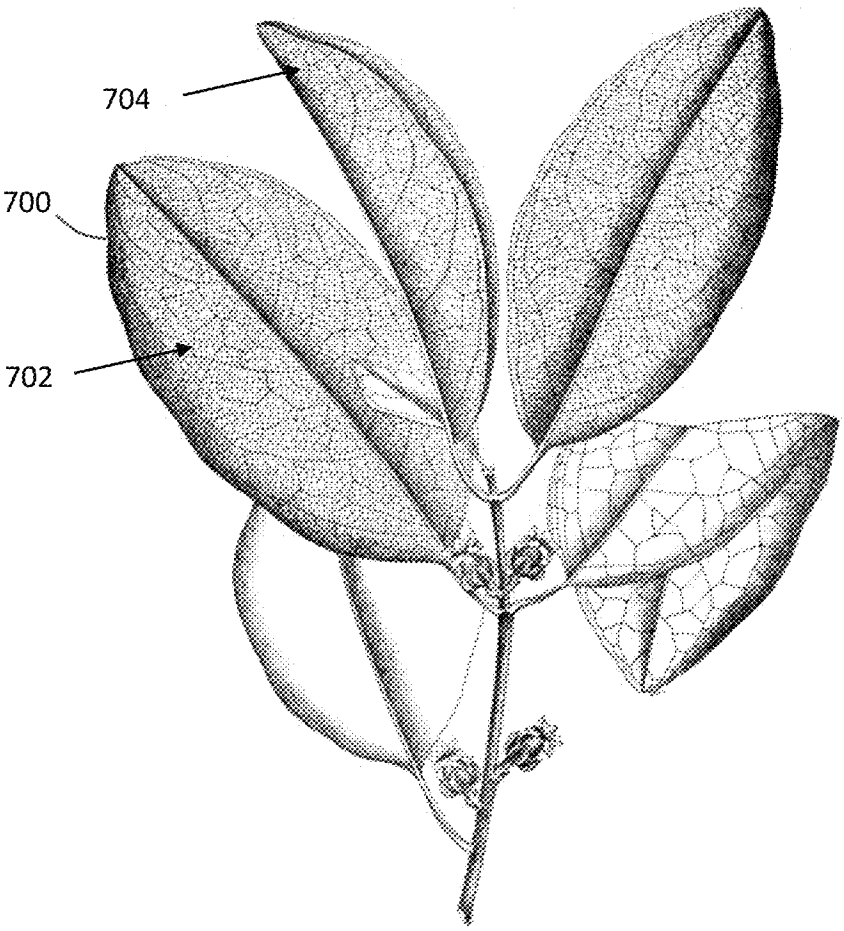
FIG. 7 is botanical drawing of *Diospyros melanoxylon* by artist Govindoo, providing reference to the unique soft hair straight trichomes present on the abaxial side of the *Diospyros melanoxylon* leaf including the diversified vein pattern of the leaf which causes exceptional uniformity of burn with hemp filler.
Figure 8:
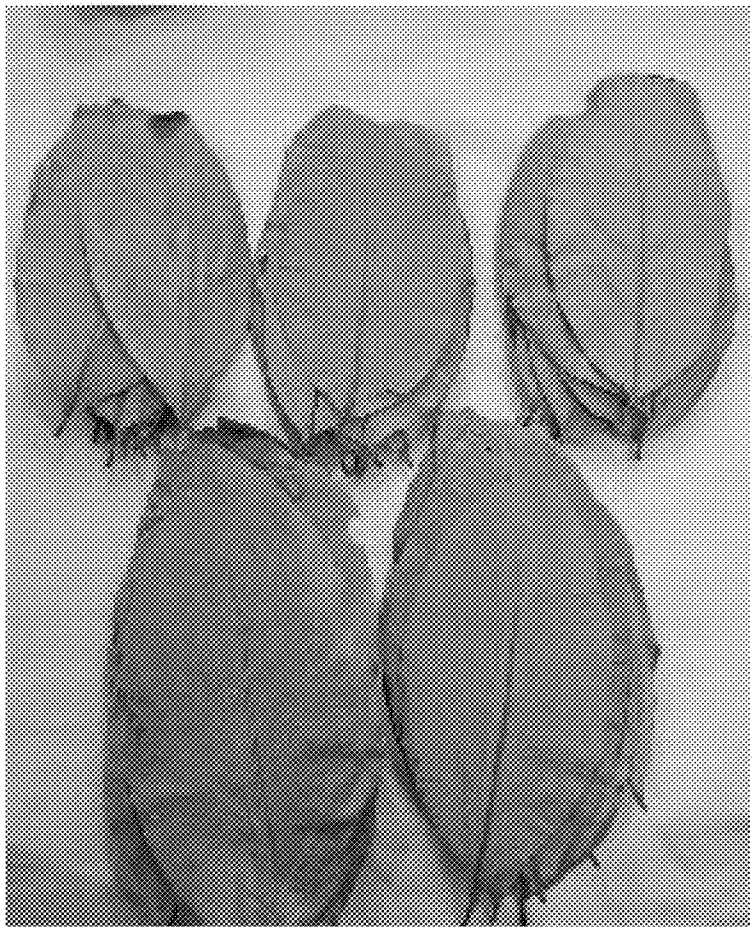
FIG. 8 is a photo of actual harvested *Diospyros melanoxylon* leaves suitable for use with hemp filler in devices depicted in FIGS. 2-2A and 3-3A.
Figure 9:
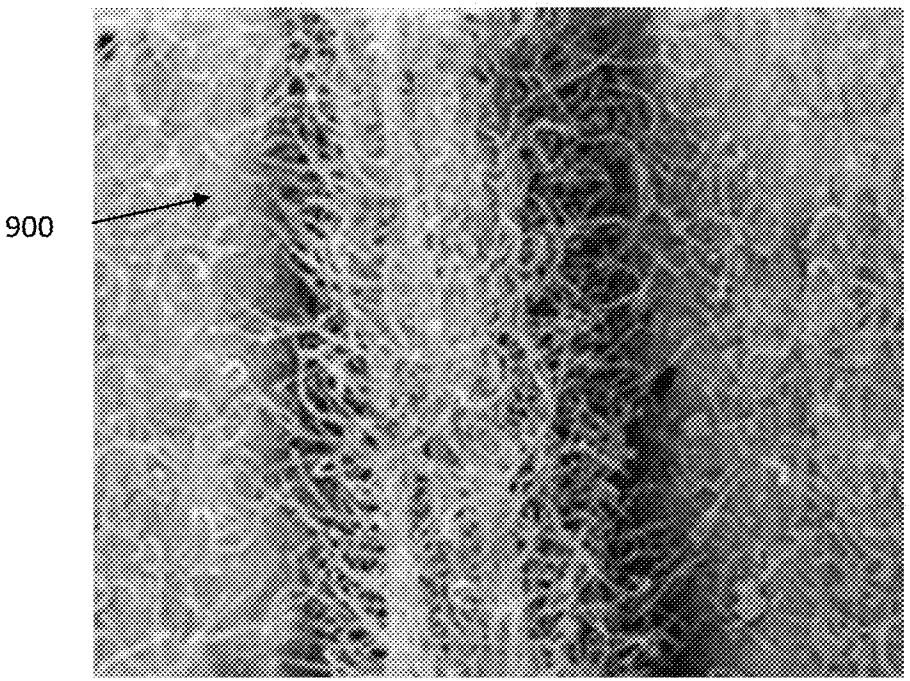
FIG. 9 is a zoomed-in view of pubescent straight trichomes disposed on the inner body surface of the *Diospyros melanoxylon* leaf body.
Figure 10:
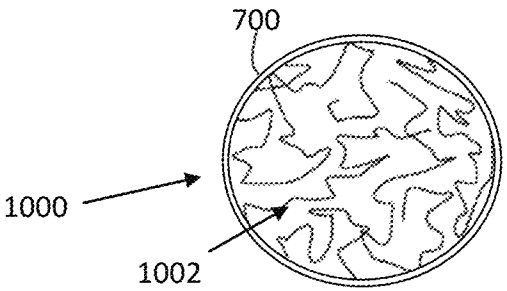
FIG. 10 is a cross-sectional view of an encased smoking product, in accordance with an exemplary embodiment of the present invention.

Referring now to FIGS. 6-8, the inventive devices 10,100 when used with hemp filler material specifically, make use of the leaf of the plant *Diospyros melanoxylon* Roxburgh. Although the *Diospyros melanoxylon* common name 'kendu' or 'tendu' is known to be used in connection with tobacco leaf, it is not globally used in the creation of smokable hemp sticks. This application of the 'kendu' leaf in the position of binder/wrapper to the device is singular to the inventor's hemp product. The *Diospyros melanoxylon* used for the binder/wrapper may be in the form of a reconstituted *Diospyros melanoxylon* paper. Not all leaves possess pubescent straight trichomes 'soft hair' on the abaxial of the leaf at the density and length of pubescent as with the *Diospyros melanoxylon*, which acts to secure the hemp in position without the addition of casings, special oils or extracts which would affect the quality of the smokable hemp stick. This unique application also allows the finished, marketable product to be labeled as organic. Providing an additional reliance by the consumer of a non-adulterated product. Not all plant leaf bears this specific pubescent. The 'kendu' leaf has been selected for use in the device additionally for its marketable unique pale green beige color. Further reference by FIG. 7, the distinct vein patterns of the leaf serve to cause even burn in a smokable hemp product.

Thus, notwithstanding the above binder/wrapper *Diospyros melanoxylon* leaf usage with hemp filler, it is noted that regardless of whether tobacco or hemp leaves which are high in quality are chosen, or which are more average in quality are chosen for the "filler" and the "binder" of the product being formed, and regardless of whether those to be used as "filler" are whole or shredded into smaller uniformly sized pieces or otherwise, the inventive method comprises an initial step of collecting leaf components which will be used to form the cigar or hemp stick product. With reference now to FIG. 4, a second step involves disposing the outer wall 115 of the device's body 112 in the expanded configuration for receiving the leaf components within the hollow interior 120 of the body 112, and sufficiently opening the access opening 130 to facilitate passage of the leaf components there-through and into the hollow interior 115. In one embodiment, the expanded configuration enables the access opening to be of a length (in some embodiments a uniform length) 40-60% of the inner diameter of the body 112. Preferably, this step will be performed with the access opening 130 facing downwardly, towards the leaf components, as shown in FIG. 4, although it is to be emphasized that there are other ways to dispose the device 100 in the expanded orientation for receiving the leaf components within it. A next step of the inventive method involves positioning the outer wall 115 into the contracted configuration shown in FIG. 3 and into enclosing relation to the leaf components within the hollow interior 120, and then, exerting sufficient biasing force radially, via the inherent bias of material used to construct the body 112 and outer wall 115, on the enclosed leaf components to form the smokable product into an intended configuration. It should be appreciated that this step can occur almost automatically given the preferred flexible material used to construct the device 100 and the at least minimal inherent bias of this material which includes memory characteristics causing or urging the device 100 to return to the contracted orientation of FIG. 3. The inventive method next includes a forming step, wherein the inventive device 100 with the leaf product located inside its body 112 and outer wall 115 hollow interior 120, is allowed to dry, set or effectively, rest for a period of time, such as but not limited to a period of generally about four (4) hours, so that the product can form, or dry off from the forming process and assume the desired shape offered by the device 100.

It is specifically pointed out that while the present inventive device 10 will likely be used to hand form cigars and hemp sticks, it could also be readily used as part of larger device, including a machine or other mechanized process for making smokable products, whether cigars, hemp sticks or smaller versions of cigars. For instance, and with reference now to FIG. 5, there is shown a housing 200 comprising a plurality of the inventive devices 210. It will be appreciated that this housing 200 could be structured and sized to receive the inventive devices, such as 10 or 100, of the type described in detail herein and used to assist with forming the resulting cigar or hemp product. Alternatively, the housing 200 could directly receive the rolled "filler" and "binder" directly into the hollow interior 220 of each device 210 and be allowed to rest, such that the outer wall 215 surrounding each device 210 within the housing will cause the leaf components to assume the desired shape offered by the device 210.

Since many modifications, variations and changes in detail can be made to the described preferred embodiment of the invention, it is intended that all matters in the foregoing description and shown in the accompanying drawings be interpreted as illustrative and not in a limiting sense. As just one example, the use of the inventive device 10, 100, 210 in both the hand-forming of and machine forming of smaller sized cigars, standard cigars and hemp products should be viewed as falling squarely within the spirit and scope of the present invention. Thus, the scope of the invention should be determined by the appended claims and their legal equivalents.

Figure 11:
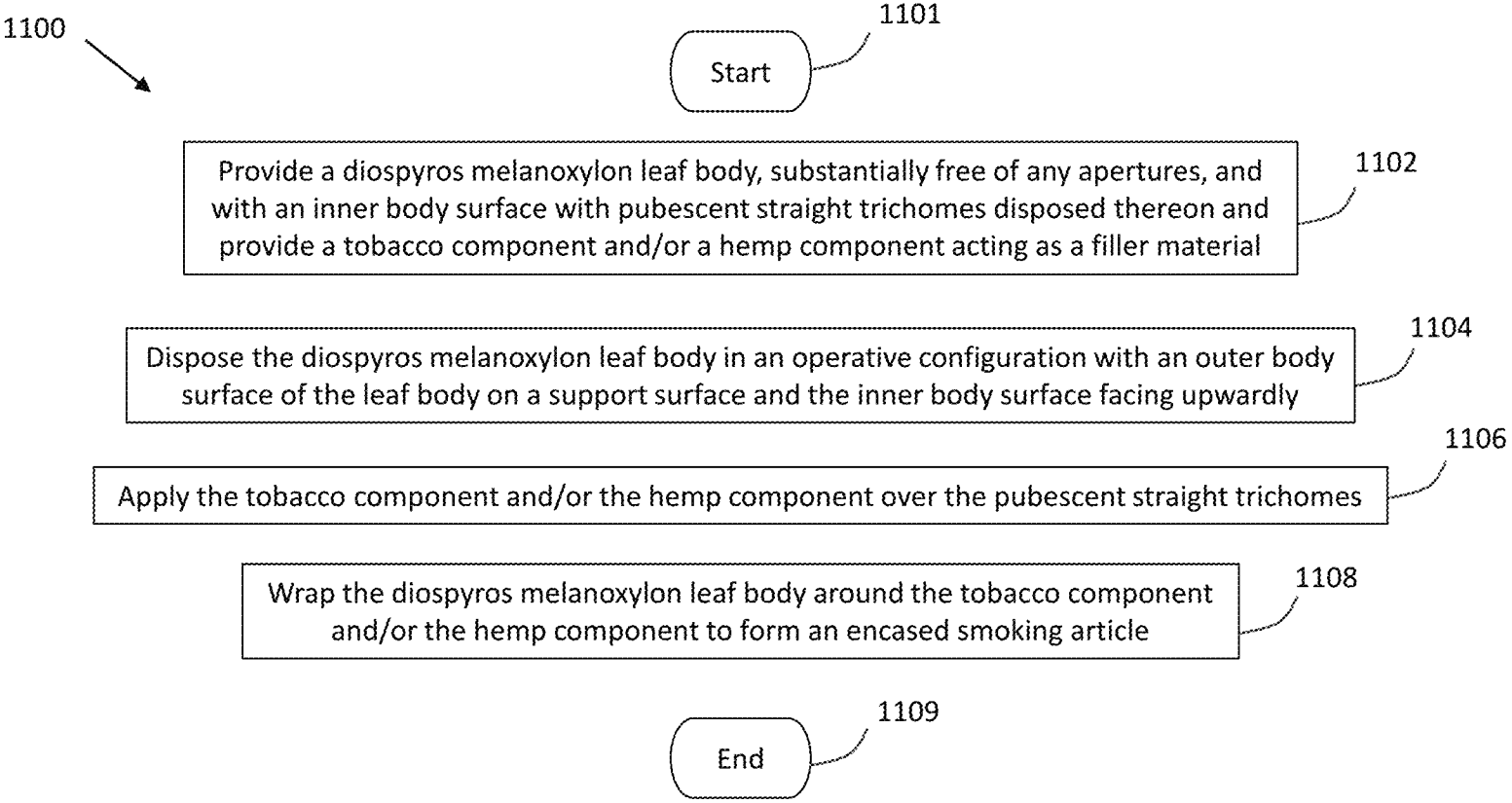
FIG. 11 is a process flow diagram depicting steps associated with a method of forming a natural leaf smoking product, in accordance with one exemplary embodiment of the present invention.

FIGS. 1-10 is described in conjunction with the process flow chart of FIG. 11. Although FIG. 11 shows a specific order of executing the process steps, the order of executing the steps may be changed relative to the order shown in certain embodiments. Also, two or more blocks shown in succession may be executed concurrently or with partial concurrence in some embodiments. Certain steps may also be omitted in FIG. 11 for the sake of brevity. In some embodiments, some or all of the process steps included in FIG. 11 can be combined into a single process.

Accordingly, the present invention is also directed to a method 1100 (best depicted in the process flow diagram of FIG. 11) of forming a natural leaf smoking product, such as but not limited to a cigar or hemp stick, but ideally, and as has been noted above, a smaller version of a cigar, using the inventive devices 10, 100. As has been described, if the goal is to offer a premium quality smokable product or smaller sized version of a cigar, the selection of high-quality leaves or blends of them will be viewed as a critical step. This step, especially with regard to the wrapper/binder leaf can be viewed as being more proprietary and selective in nature.

The method 1100 of forming a natural leaf smoking product comprises an initial step 1102 of providing a *Diospyros melanoxylon* leaf body 700 acting as a binder material, substantially free of any apertures, having an inner body surface 702 with pubescent straight trichomes 900 disposed thereon, and having an outer body surface 704 opposing the inner surface 702 of the *diospyros melanoxylon* leaf. As explained in greater detail above, the pubescent straight trichomes 900 on the abaxial of the *Diospyros melanoxylon* leaf body 700 secure the hemp in position without the addition of casings, special oils or extracts which would affect the quality of the smokable hemp stick. This unique application also allows the finished, marketable product to be labeled as organic. Using the *Diospyros melanoxylon*, or "Kendu", leaf with hemp and the pubescent straight trichomes 900 on the underside of the Kendu leaf with fibrous pubescent on hemp is a novel feature, as the fibrous pubescent facilitates in attaching the hemp to the pubescent straight trichomes 900, thereby creating more natural smokable product and eliminating casings typically used by tobacco. In an alternate embodiment, a recycled reconstituted *Diospyros melanoxylon* paper formed from pieces of *Diospyros melanoxylon* leaf may be provided as the binder material. Step 1102 also includes providing a hemp component 1002 acting as a filler material within the natural lead smoking product, though in alternate embodiments a tobacco component may be utilized or a combination of hemp and tobacco components may be utilized. In a preferred embodiment, only the hemp component 1002 is provided.

With reference now to FIG. 4 and FIG. 11, a second step 1104 involves disposing the *Diospyros melanoxylon* leaf body 700 in an operative configuration with the outer body surface 704 on a support surface and the inner body surface 702 facing upwardly for receiving the hemp component 1002. In an exemplary embodiment, the support surface is substantially planar, i.e., flat or relating to or in the form of a plane, to provide a more stable and secure support surface for a user. In one embodiment, step 1104 involves disposing the outer wall 115 of the device's body 112 in the expanded configuration for receiving the leaf components within the hollow interior 120 of the body 112, and sufficiently opening the access opening 130 to facilitate passage of the leaf components there-through and into the hollow interior 115. In one embodiment, the expanded configuration enables the access opening to be of a length (in some embodiments a uniform length) 40-60% of the inner diameter of the body 112. Preferably, this step will be performed with the access opening 130 facing downwardly, towards the leaf components, as shown in FIG. 4, although it is to be emphasized that there are other ways to dispose the device 100 in the expanded orientation for receiving the leaf components within it.

Step 1106 involves applying the hemp component 1002 over the pubescent straight trichomes 900. In one embodiment, the hemp component 1002 are applied exclusively over a length and density of the pubescent straight trichomes 900 which beneficially serves to secure the hemp component 1002 in position without the addition of casings, special oils or extracts, creating a more natural smokable product. A next step 1108 involves wrapping the *Diospyros melanoxylon* leaf body 700 around the hemp component 1002 to form an encased smoking product 1000. In one embodiment, the method 1100 may also involve disposing the body in an operative relation for receiving the hemp component 1002 within the hollow interior, disposing the outer wall in the expanded orientation and sufficiently opening the access opening to facilitate passage of the hemp component 1002 therethrough into the hollow interior, positioning the outer wall 115 into the contracted configuration shown in FIG. 3 and in enclosing relation to the hemp component 1002 within the hollow interior, and then, exerting sufficient biasing force radially, via the inherent bias of the outer wall 115, on the enclosed hemp component 1002 to form the encased smoking product 1000 and an intended configuration. It should be appreciated that this step can occur almost automatically given the preferred flexible material used to construct the device 100 and the at least minimal inherent bias of this material which includes memory characteristics causing or urging the device 100 to return to the contracted orientation of FIG. 3. The inventive device 100 with the leaf product located inside its body 112 and outer wall 115 hollow interior 120, is preferably allowed to dry, set or effectively, rest for a period of time, such as but not limited to a period of generally about four (4) hours, so that the product can form, or dry off from the forming process and assume the desired shape offered by the device 100.

The method 1100 may also comprise the step of providing the rolling device 100 with the body 12 of an elongated configuration and having two opposing free ends 14, 16 separated by a length and the outer wall 15 extending the length of the body 12 and surrounding and defining the hollow interior spanning the length of the body and defining the boundary thereof; and disposing the *Diospyros melanoxylon* leaf body 700 in the operative configuration with the outer body surface confronting the inner surface of the outer wall 15 of the body 12, forming the support surface.

In accordance with a further feature, the method 1100 may comprise the additional step of assembling the hemp component 1002 (and/or a tobacco component) into a preformed *diospyros melanoxylon* leaf body 700 and disposing the preformed *Diospyros melanoxylon* leaf body 700 into the hollow interior. In one embodiment, the outer wall and the inherent bias are operably configured or structured to exert a sufficient biasing force on the outer wall of the preformed *Diospyros melanoxylon* leaf body 700 to shape the *Diospyros melanoxylon* leaf body 700 into the intended configuration. Said differently, a user must dexterously manipulate the *diospyros melanoxylon* leaf body 700 into the intended configuration.

In one embodiment, the preformed *Diospyros melanoxylon* leaf body 700 is placed within the hollow interior of the body by hand. In an alternate embodiment, the preformed *diospyros melanoxylon* leaf body 700 is placed within the hollow interior of the body by machine. These features beneficially provide for flexibility in application such that the natural leaf smoking products may be either made in small batched by hand or mass-produced by machinery as part of a manufacturing process.

In another embodiment, the method 1100 includes a step of providing a rolling device 10 with a body 12 with an elongated configuration and an outer wall 15 extending along the length of said body 12, the body 12 including a hollow interior 20 terminating at opposite ends 14, 16 of said body 12, the outer wall 15 disposed in an at least partially surrounding relation to said hollow interior 20 and structured to define a circumferential boundary thereof, and the outer wall 15 comprising a continuous, one piece, flexible material construction including an at least minimal inherent bias; and a further step of forming an access opening 130 formed in said outer wall 115 and extending along a length thereof in communicating relation to said hollow interior 120, the outer wall 115 disposable in and between expanded and contracted orientations upon an opening and at least partial closing of said access opening 130 and the inherent bias being sufficient to normally dispose said outer wall 115 into said contracted orientation and in confronting, forming relation to the *Diospyros melanoxylon* leaf body 700 disposed within the hollow interior 120. In a preferred embodiment, the inherent bias is at least sufficient to exert a compressive biasing force on the *Diospyros melanoxylon* leaf body 700 within the hollow interior 120 when the outer wall 115 is in said contracted orientation. The expanded orientation preferably comprises a sufficient opening of said access opening 130 to dispose the *Diospyros melanoxylon* leaf body 700 within said hollow interior 120. In other words, the expanded orientation facilitates the disposition of the *Diospyros melanoxylon* leaf body 700 within the hollow interior 120, whether done by hand or by machine, and the contracted orientation assists in securely retaining the *Diospyros melanoxylon* leaf body 700 within the hollow interior 120 thereafter and during use.

Now that the invention has been described,

What is claimed is:

1. A method of forming a natural leaf smoking product comprising:

providing a *Diospyros melanoxylon* leaf body acting as a binder material, substantially free of any apertures, having an inner body surface with pubescent straight trichomes disposed thereon, and having an outer body surface opposing the inner surface of the *Diospyros melanoxylon* leaf;

providing a hemp component acting as a filler material, disposing the *Diospyros melanoxylon* leaf body in an operative configuration with the outer body surface on a support surface and the inner body surface facing upwardly for receiving the hemp component;

applying the hemp component over the pubescent straight trichomes; and wrapping the *Diospyros melanoxylon* leaf body around the hemp component to form an encased smoking product.

2. The method according to claim 1, further comprising:

providing a recycled reconstituted *Diospyros melanoxylon* paper from pieces of *diospyros melanoxylon* leaf.

3. The method according to claim 1, further comprising:

applying the hemp component exclusively over a length and density of the pubescent straight trichomes.

4. The method according to claim 1, further comprising:

providing a rolling device with a body of an elongated configuration and having two opposing free ends separated by a length and an outer wall extending the length of the body and surrounding and defining a hollow interior spanning the length of the body and defining a boundary thereof; and disposing the *Diospyros melanoxylon* leaf body in the operative configuration with the outer body surface confronting an inner surface of the outer wall of the body, forming the support surface.

5. The method according to claim 4, further comprising:

disposing the body in an operative relation for receiving the hemp component within the hollow interior;

disposing the outer wall in the expanded orientation and sufficiently opening the access opening to facilitate passage of the hemp component therethrough into the hollow interior;

positioning the outer wall into the contracted orientation and in enclosing relation to the hemp component within the hollow interior; and exerting sufficient biasing force, via the inherent bias of the outer wall, on the enclosed hemp component to form the encased smoking product and an intended configuration.

6. The method according to claim 5, further comprising:

assembling the hemp component into a preformed *Diospyros melanoxylon* leaf body and disposing the preformed *Diospyros melanoxylon* leaf body into the hollow interior.

7. The method according to claim 6, further comprising:

further comprising a structuring the outer wall and the inherent bias to exert a sufficient biasing force on the outer wall of the preformed *Diospyros melanoxylon* leaf body to shape the *Diospyros melanoxylon* leaf body into the intended configuration.

8. The method according to claim 7, further comprising:

placing the preformed *Diospyros melanoxylon* leaf body within the hollow interior of the body by hand.

9. The method according to claim 8, further comprising:

placing the preformed *Diospyros melanoxylon* leaf body within the hollow interior of the body by machine.

10. The method according to claim 4, further comprising:

providing the body formed of a rigid and flexible material.

11. The method according to claim 1, further comprising:

providing a rolling device with a body with an elongated configuration and an outer wall extending along the length of said body, the body including a hollow interior terminating at opposite ends of said body, the outer wall disposed in an at least partially surrounding relation to said hollow interior and structured to define a circumferential boundary thereof, and the outer wall comprising a continuous, one piece, flexible material construction including an at least minimal inherent bias; and forming an access opening formed in said outer wall and extending along a length thereof in communicating relation to said hollow interior, the outer wall disposable in and between expanded and contracted orientations upon an opening and at least partial closing of said access opening and the inherent bias being sufficient to normally dispose said outer wall into said contracted orientation and in confronting, forming relation to the *Diospyros melanoxylon* leaf body disposed within the hollow interior.

12. The method according to claim 11, wherein the inherent bias is at least sufficient to exert a compressive biasing force on the *Diospyros melanoxylon* leaf body within said hollow interior when said outer wall is in said contracted orientation.

13. The method according to claim 12, wherein said expanded orientation comprises a sufficient opening of said access opening to dispose the *Diospyros melanoxylon* leaf body within said hollow interior.

14. The method according to claim 13, wherein each of said opposite ends of said body are open and disposed in communicating relation with said hollow interior.

15. The method according to claim 14, wherein said access opening extends along the length of said outer wall between and in communication with both said open opposite ends.

16. The method according to claim 15, wherein said access opening comprises a substantially linear configuration disposed in aligned relation to a longitudinal access of said hollow interior, at least when said outer wall is in said contracted orientation.

17. The method according to claim 16, wherein said outer wall and said inherent bias are cooperatively structured to define said circumferential dimension of said hollow interior to be in substantial conformance to an outer surface of the *Diospyros melanoxylon* leaf body disposed therein, when said outer wall is in said contracted orientation.

18. The method according to claim 17, wherein said substantial conformance of said circumferential dimension of said hollow interior with the *Diospyros melanoxylon* leaf body extends along substantially an entire length of the natural leaf product.

19. The method according to claim 18, wherein the length of said outer wall is equal to or greater than the length of the *Diospyros melanoxylon* leaf body being formed within said hollow interior.

20. The method according to claim 19, wherein the length of said outer wall is equal to or greater than a length of the *Diospyros melanoxylon* leaf body being formed within said hollow interior.

* * * * *